US011424573B2

(12) United States Patent
Amini et al.

(10) Patent No.: US 11,424,573 B2
(45) Date of Patent: Aug. 23, 2022

(54) MAGNETIC CONNECTORS WITH SELF-CENTERING FLOATING CONTACTS

(71) Applicant: Apple Inc., Cupertino, CA (US)

(72) Inventors: Mahmoud R. Amini, Sunnyvale, CA (US); Ayoub Yari Boroujeni, San Jose, CA (US); John C. DiFonzo, Redwood City, CA (US); Bradley J. Hamel, Redwood City, CA (US); George Tziviskos, San Jose, CA (US); Hao Zhu, San Jose, CA (US); Paul Hack, San Jose, CA (US); Jean-March Gery, Playa Del Rey, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 17/031,106

(22) Filed: Sep. 24, 2020

(65) Prior Publication Data

US 2022/0094105 A1 Mar. 24, 2022

(51) Int. Cl.
*H01R 13/62* (2006.01)
*H01R 13/6581* (2011.01)
*H01R 13/11* (2006.01)

(52) U.S. Cl.
CPC ..... *H01R 13/6205* (2013.01); *H01R 13/112* (2013.01); *H01R 13/6581* (2013.01)

(58) Field of Classification Search
CPC ..... H01R 13/6205; H01R 13/112; H01R 13/6581; H01R 11/30
USPC ..... 439/39
See application file for complete search history.

(56) References Cited

U.S. PATENT DOCUMENTS

| | | | |
|---|---|---|---|
| 2,170,287 | A | 8/1939 | Kinnebrew |
| 2,234,982 | A | 3/1941 | Ross |
| 2,869,091 | A | 1/1959 | Robards |
| 3,144,527 | A | 8/1964 | Tolegian |

(Continued)

FOREIGN PATENT DOCUMENTS

| | | |
|---|---|---|
| CA | 2122915 | 3/1994 |
| CN | 2523065 | 11/2002 |

(Continued)

OTHER PUBLICATIONS

Break-Away Cord Aims to Make Deep Fryers Safer, CNN.com, Available Online at: http:/larchives.cnn.com/2001/US/07/03/deep.fryers/, Jul. 4, 2001, 2 pages.

(Continued)

*Primary Examiner* — Peter G Leigh
(74) *Attorney, Agent, or Firm* — Kilpatrick Townsend & Stockton, LLP

(57) ABSTRACT

Connectors that have a low profile, can form strong and reliable connections despite connection alignment errors, and can be readily manufactured. One example can provide a connector receptacle having a magnetic array arranged to provide a strong attachment that allows the use of a low profile connector receptacle and connector insert. The magnetic array can include magnets and magnetic elements, where the magnetic elements can be magnetically conductive pole-pieces. Each pole piece can have magnets at two of its sides. Another example can provide contacts for a connector insert that can have more than one contacting surface to connect to a contact of a connector receptacle.

28 Claims, 16 Drawing Sheets

(56) References Cited

U.S. PATENT DOCUMENTS 3,363,214 A 1/1968 Wright
3,431,428 A 3/1969 Valer
3,521,216 A 7/1970 Tolegian
3,713,370 A 1/1973 Prijn
3,786,391 A 1/1974 Mathauser
3,808,577 A 4/1974 Mathauser
3,810,258 A 5/1974 Mathauser
3,868,160 A 2/1975 Kersman
3,877,775 A 4/1975 Barlow et al.
4,004,298 A 1/1977 Freed
4,211,456 A 7/1980 Sears
4,317,969 A 3/1982 Riegler et al.
4,580,862 A 4/1986 Johnson
4,669,791 A 6/1987 Savill
4,712,234 A 12/1987 Below et al.
4,810,202 A 3/1989 Nodfelt
4,844,582 A 7/1989 Giannini
5,244,415 A 9/1993 Marsilio et al.
5,364,292 A 11/1994 Bethurum
5,382,167 A 1/1995 Janson, Jr.
5,385,476 A 1/1995 Jasper
5,506,560 A * 4/1996 Takeuchi ..... H01F 27/255 336/212
5,662,480 A 9/1997 Togashi
5,677,407 A 10/1997 Sojka
5,692,786 A 12/1997 Berger
5,696,861 A 12/1997 Schimmeyer et al.
5,704,802 A 1/1998 Loudermilk
5,812,356 A 9/1998 O'Connor
5,829,987 A 11/1998 Fritsch et al.
5,836,785 A 11/1998 Lee
5,865,645 A 2/1999 Embo et al.
5,873,737 A 2/1999 Hashizawa et al.
5,885,100 A 3/1999 Talend et al.
5,907,231 A * 5/1999 Watanabe ..... H01F 38/14 320/108
5,909,100 A * 6/1999 Watanabe ..... B60L 53/126 320/108
5,917,307 A * 6/1999 Watanabe ..... H01F 38/14 320/108
5,921,783 A 7/1999 Fritsch et al.
5,941,729 A 8/1999 Sri-Jayantha
5,954,520 A 9/1999 Schmidt
6,007,363 A 12/1999 Renk
6,030,229 A 2/2000 Tsutsui
6,042,385 A * 3/2000 Watanabe ..... B60L 53/34 439/38
6,088,752 A 7/2000 Ahern
6,094,122 A 7/2000 Sexton
6,135,821 A * 10/2000 Liu ..... H01R 24/64 439/701
6,165,006 A 12/2000 Yeh et al.
6,174,194 B1 1/2001 Bleicher et al.
6,183,264 B1 2/2001 Harsányi
6,211,581 B1 4/2001 Farrant
6,217,339 B1 4/2001 Tsubata
6,219,267 B1 4/2001 Andres
6,238,219 B1 5/2001 Wu
6,250,931 B1 6/2001 Mendelson
6,267,602 B1 7/2001 Mendelson et al.
6,312,268 B1 * 11/2001 Chih-Kai ..... H01R 13/508 439/108
6,340,302 B1 1/2002 Ladd
6,358,069 B2 3/2002 Yoshioka et al.
6,419,521 B2 7/2002 Kanagawa et al.
6,431,902 B1 8/2002 Yeh
6,464,509 B1 10/2002 Emberty et al.
6,466,718 B1 10/2002 Linnell
6,478,614 B1 11/2002 De'Longhi
6,485,338 B1 11/2002 Wu
6,522,033 B1 2/2003 Nevo
6,527,570 B1 3/2003 Hartman et al.
6,528,746 B2 3/2003 DeWitt et al.
6,545,577 B2 4/2003 Yap
6,561,815 B1 * 5/2003 Schmidt ..... H01R 13/7037 439/38
6,565,363 B2 5/2003 Downing
6,595,801 B1 7/2003 Leonard et al.
6,607,391 B2 8/2003 Mendelson et al.
6,616,468 B2 9/2003 Sakiyama
6,623,276 B2 9/2003 Ferrerfábrega et al.
6,663,415 B1 12/2003 Wu
6,727,477 B1 4/2004 Li-Chen
6,733,333 B1 5/2004 Chen
6,773,312 B2 8/2004 Bauer et al.
6,814,626 B2 11/2004 Wen-Yao
6,815,610 B2 11/2004 Kuboshima et al.
6,821,126 B2 11/2004 Neidlein
6,887,096 B2 5/2005 Matumoto et al.
6,966,781 B1 11/2005 Bullinger et al.
6,976,882 B2 12/2005 Kernan
6,988,897 B2 1/2006 Belongia et al.
6,991,483 B1 1/2006 Milan et al.
7,032,288 B2 4/2006 Ladd
7,066,739 B2 6/2006 McLeish
7,097,499 B1 8/2006 Purdy
7,112,103 B2 9/2006 Zhang et al.
7,121,707 B2 10/2006 Currie et al.
7,198,295 B2 4/2007 Biziorek et al.
7,217,142 B1 5/2007 Wu
7,247,046 B1 7/2007 Wu
7,261,588 B2 8/2007 Yokoyama
7,264,479 B1 9/2007 Lee
7,306,479 B1 12/2007 Wu
7,311,526 B2 12/2007 Rohrbach et al.
7,329,128 B1 2/2008 Awad
7,332,990 B2 2/2008 Lo et al.
7,344,380 B2 * 3/2008 Neidlein ..... H01R 13/6205 439/378
7,351,066 B2 4/2008 DiFonzo et al.
7,364,433 B2 4/2008 Neidlein
7,419,378 B2 9/2008 Ha et al.
7,429,188 B2 9/2008 Wu
7,445,452 B1 11/2008 Wu
7,488,188 B2 * 2/2009 Moriyama ..... H01R 13/26 439/108
7,497,693 B1 3/2009 Wu
7,498,546 B2 3/2009 Belongia et al.
7,517,222 B2 4/2009 Rohrbach et al.
7,625,213 B1 * 12/2009 Tse ..... H01R 13/6205 439/39
7,641,477 B2 1/2010 DiFonzo et al.
7,645,143 B2 1/2010 Rohrbach et al.
7,658,613 B1 * 2/2010 Griffin ..... H01R 13/6205 439/39
7,717,733 B1 5/2010 Yi et al.
7,775,801 B2 8/2010 Shiff et al.
7,901,216 B2 3/2011 Rohrbach et al.
7,931,472 B2 4/2011 David et al.
7,963,773 B2 6/2011 Palli et al.
8,043,123 B2 10/2011 Hsieh
8,057,248 B1 11/2011 Sherman
8,087,939 B2 1/2012 Rohrbach et al.
8,172,579 B2 5/2012 Pan
8,172,580 B1 5/2012 Chen et al.
8,177,560 B2 5/2012 Rohrbach et al.
8,241,043 B1 8/2012 Lin
8,342,857 B2 1/2013 Palli et al.
8,388,354 B1 3/2013 Lin et al.
8,435,042 B2 5/2013 Rohrbach et al.
8,465,296 B1 6/2013 Lin et al.
8,497,753 B2 7/2013 DiFonzo et al.
8,535,088 B2 9/2013 Gao et al.
8,690,582 B2 4/2014 Rohrbach et al.
8,888,500 B2 11/2014 Gao et al.
8,926,352 B2 * 1/2015 Wang ..... H01R 12/57 439/250
8,947,185 B2 * 2/2015 Fullerton ..... G06F 1/1616 335/285
9,017,092 B1 * 4/2015 McCracken ..... H01R 13/629 439/374
9,065,205 B2 6/2015 Gao et al.

(56) References Cited

U.S. PATENT DOCUMENTS

| | | | | |
|---|---|---|---|---|
| 9,112,304 | B2 | 8/2015 | Rohrbach et al. | |
| 9,245,677 | B2 * | 1/2016 | Fullerton | H01F 7/0273 |
| 9,252,543 | B2 * | 2/2016 | Huang | H01R 13/6205 |
| 9,478,901 | B2 | 10/2016 | Chen et al. | |
| 9,685,733 | B2 * | 6/2017 | Zhao | H01R 13/6205 |
| 9,711,893 | B2 | 7/2017 | Rohrbach et al. | |
| 9,780,484 | B2 * | 10/2017 | DiFonzo | H01R 43/26 |
| 9,780,503 | B2 * | 10/2017 | Huang | H01R 13/6658 |
| 9,825,382 | B2 * | 11/2017 | Xiao | H05K 1/184 |
| 10,090,618 | B2 | 10/2018 | Rohrbach et al. | |
| 10,135,166 | B2 * | 11/2018 | Tian | H01R 24/60 |
| 10,333,249 | B1 * | 6/2019 | Wang | H01R 13/6205 |
| 10,490,933 | B2 | 11/2019 | Rohrbach et al. | |
| 2002/0002004 | A1 | 1/2002 | Akama et al. | |
| 2002/0044746 | A1 | 4/2002 | Kronlund et al. | |
| 2002/0054686 | A1 | 5/2002 | Tabata et al. | |
| 2002/0123250 | A1 | 9/2002 | Wang | |
| 2003/0148643 | A1 | 8/2003 | Yoji | |
| 2004/0077187 | A1 | 4/2004 | Belongia et al. | |
| 2004/0184295 | A1 | 9/2004 | Robertson et al. | |
| 2004/0209489 | A1 | 10/2004 | Clapper | |
| 2004/0224539 | A1 | 11/2004 | Boyd et al. | |
| 2004/0257741 | A1 | 12/2004 | Cuny et al. | |
| 2005/0082915 | A1 | 4/2005 | Steinberg | |
| 2005/0208783 | A1 | 9/2005 | Suzuki et al. | |
| 2005/0255716 | A1 | 11/2005 | Tanaka et al. | |
| 2005/0255718 | A1 | 11/2005 | McLeish | |
| 2005/0255719 | A1 | 11/2005 | Heidlein | |
| 2006/0051981 | A1 | 3/2006 | Neidlein et al. | |
| 2006/0067690 | A1 | 3/2006 | Tatum et al. | |
| 2006/0164447 | A1 | 7/2006 | Poole et al. | |
| 2007/0067654 | A1 | 3/2007 | Adachi | |
| 2007/0072443 | A1 | 3/2007 | Rohrbach et al. | |
| 2007/0085516 | A1 | 4/2007 | Fenwick et al. | |
| 2007/0107068 | A1 | 5/2007 | Kelley et al. | |
| 2007/0112989 | A1 | 5/2007 | Iwaki | |
| 2007/0184674 | A1 | 8/2007 | Koch | |
| 2008/0003867 | A1 | 1/2008 | Wu | |
| 2008/0003881 | A1 | 1/2008 | Wu | |
| 2008/0096398 | A1 | 4/2008 | Rohrbach et al. | |
| 2008/0102687 | A1 * | 5/2008 | Tsou | H01R 9/2491 439/404 |
| 2008/0211310 | A1 | 9/2008 | Jitaru et al. | |
| 2009/0142962 | A1 | 6/2009 | Zhang | |
| 2009/0181556 | A1 | 7/2009 | Rohrbach et al. | |
| 2009/0269943 | A1 | 10/2009 | Palli et al. | |
| 2010/0080563 | A1 | 4/2010 | Difonzo et al. | |
| 2010/0178801 | A1 | 7/2010 | Miyashita et al. | |
| 2010/0240229 | A1 | 9/2010 | Firman, II et al. | |
| 2010/0279517 | A1 | 11/2010 | Tsai | |
| 2011/0092081 | A1 | 4/2011 | Gao et al. | |
| 2011/0136350 | A1 | 6/2011 | Palli et al. | |
| 2012/0083137 | A1 | 4/2012 | Rohrbach et al. | |
| 2012/0148196 | A1 | 6/2012 | Penumatcha et al. | |
| 2012/0295451 | A1 | 11/2012 | Hyun-Jun et al. | |
| 2013/0005159 | A1 | 1/2013 | Gao et al. | |
| 2013/0040470 | A1 | 2/2013 | Gao et al. | |
| 2013/0065406 | A1 | 3/2013 | Rohrbach et al. | |
| 2013/0316549 | A1 | 11/2013 | DiFonzo et al. | |
| 2014/0087569 | A1 | 3/2014 | Lee | |
| 2014/0235075 | A1 | 8/2014 | Kim et al. | |
| 2014/0285957 | A1 | 9/2014 | Rohrbach et al. | |
| 2014/0287601 | A1 | 9/2014 | Suh | |
| 2015/0111398 | A1 | 4/2015 | Isenhour et al. | |
| 2015/0207267 | A1 | 7/2015 | Gao et al. | |
| 2015/0207268 | A1 | 7/2015 | Zhu et al. | |
| 2015/0214654 | A1 | 7/2015 | Huang et al. | |
| 2015/0244105 | A1 | 8/2015 | Peng | |
| 2015/0333448 | A1 | 11/2015 | Wu et al. | |
| 2015/0357753 | A1 | 12/2015 | Lee | |
| 2016/0006187 | A1 | 1/2016 | Kim et al. | |
| 2016/0013582 | A1 | 1/2016 | Byrne et al. | |
| 2016/0064854 | A1 | 3/2016 | Schooley | |
| 2016/0079696 | A1 * | 3/2016 | Krishnamoorthy | H01R 12/732 439/786 |
| 2016/0218462 | A1 | 7/2016 | Zhao et al. | |
| 2016/0285198 | A1 | 9/2016 | Zhou et al. | |
| 2019/0027861 | A1 * | 1/2019 | Brown | H01R 13/6205 |

FOREIGN PATENT DOCUMENTS

| | | | | |
|---|---|---|---|---|
| CN | 201252244 | | 6/2009 | |
| CN | 102074824 | | 5/2011 | |
| CN | 108028497 | B * | 6/2020 | H01R 13/44 |
| DE | 3622948 | | 1/1988 | |
| DE | 3904708 | | 1/1990 | |
| DE | 19512335 | | 8/1996 | |
| DE | 19820691 | | 2/1999 | |
| DE | 10242645 | | 3/2004 | |
| DE | 202004003202 | | 6/2004 | |
| DE | 10333403 | | 9/2004 | |
| DE | 60215070 | | 11/2006 | |
| DE | 202010002522 | | 8/2010 | |
| EP | 0112019 | | 6/1984 | |
| EP | 0289208 | | 11/1988 | |
| EP | 0573471 | | 10/1994 | |
| EP | 1194983 | | 4/2002 | |
| EP | 1194986 | | 4/2002 | |
| FR | 2566195 | | 12/1985 | |
| FR | 2638907 | | 5/1990 | |
| FR | 2665305 | | 1/1992 | |
| FR | 2685981 | | 7/1993 | |
| GB | 1232922 | | 5/1971 | |
| GB | 2174556 | | 11/1986 | |
| GB | 2360637 | | 9/2001 | |
| GB | 2383476 | | 6/2003 | |
| JP | 509990 | | 1/1975 | |
| JP | 03059973 | | 3/1991 | |
| JP | 04296475 | | 10/1992 | |
| JP | 05335051 | | 12/1993 | |
| JP | 076817 | | 1/1995 | |
| JP | 1027660 | | 1/1998 | |
| JP | 119467 | | 1/1999 | |
| JP | 11144803 | | 5/1999 | |
| JP | 11273770 | | 10/1999 | |
| JP | 200012145 | | 1/2000 | |
| JP | 200030806 | | 1/2000 | |
| JP | 2000068007 | | 3/2000 | |
| JP | 2002056929 | | 2/2002 | |
| JP | 2002075557 | | 3/2002 | |
| JP | 2002270279 | | 9/2002 | |
| JP | 2002367724 | | 12/2002 | |
| JP | 2003082519 | | 3/2003 | |
| JP | 2003163046 | | 6/2003 | |
| JP | 2004206973 | | 7/2004 | |
| JP | 2006095040 | | 4/2006 | |
| KR | 20100031626 | | 3/2010 | |
| WO | 9216002 | | 9/1992 | |
| WO | 9406174 | | 3/1994 | |
| WO | 9506970 | | 3/1995 | |
| WO | 2004027937 | | 4/2004 | |
| WO | 2004095647 | | 11/2004 | |
| WO | 2005006913 | | 1/2005 | |
| WO | 2011049838 | | 4/2011 | |

OTHER PUBLICATIONS

Consumer Product Safety Review, U.S. Consumer Product Safety Commission, Winter, vol. 6, No. 3, 2002, 7 pages.

Magnetic Cord for Electric Deep Fryers, National Presto Industries, Inc., Available Online at: http://www.gopresto.com/products/products.phpstock=09982, Jan. 18, 2006, 1 page.

News for Break Away Power Cords on Electric Deep Fryers, Dowell Trading Co. Ltd., 2002, 1 page.

Presto 9984 Control Master Heat Control with Magnetic Cord, Available Online at: http://www.cookingandcanning.net/pr99comaheco.html, generated, Jan. 18, 2006, 1 page.

Zojirushi Hot Water Dipensing Pot Review, Available Online at: http://www. pkshiu. comtlof/arch ive/2005/01/zojirusji-h ot-water-dispensing-pot.cndot.review, Jan. 5, 2005, 2 pages.

* cited by examiner

MAGNETIC CONNECTORS WITH SELF-CENTERING FLOATING CONTACTS

BACKGROUND

Electronic devices can share power and data over cables that can include one or more wires, fiber optic cables, or other conductors. Connector inserts can be located at each end of these cables and can be inserted into connector receptacles in the communicating electronic devices to form power and data pathways.

Unfortunately, these connector receptacles can consume a large amount of space on a surface of these electronic devices. At the same time, these electronic devices have become smaller and thinner over the past several years. This can make it difficult for designers to find appropriate locations for connector receptacles on new electronic devices. Accordingly, it can be desirable to have connector receptacles that can have a low profile and can be utilized with these new smaller and thinner devices.

An electronic device can house a connector receptacle that can receive power and data through a connector insert attached to a first end of a cable. The cable can be subject to forces that can work to dislodge the connector insert from the connector receptacle, thereby interrupting the flow of power and data. Accordingly, it can be desirable to provide connector systems that can form a strong attachment between the connector insert and the connector receptacle.

A connector receptacle can be located on an electronic device in a position where it will be out of the way when the electronic device is being used. This can mean that a user might not have a direct view of the connector receptacle as the connector insert is plugged in. Accordingly, it can be desirable that a connection can be made despite the connector insert being misaligned with the connector receptacle.

Also, some of these electronic devices become tremendously popular. As a result, connector receptacles on the electronic devices and connector inserts on cables can be sold in very large quantities. Therefore, it can be desirable that these connectors be readily manufactured such that customer demand for them can be met.

Thus, what is needed are connectors that have a low profile, can form strong and reliable connections despite connection alignment errors, and can be readily manufactured.

SUMMARY

Accordingly, embodiments of the present invention can provide connectors that have a low profile, can form strong and reliable connections despite connection alignment errors, and can be readily manufactured. An illustrative embodiment of the present invention can provide a connector receptacle having a magnetic array arranged to provide a strong attachment that allows the use of a low profile connector receptacle and connector insert. The magnetic array can include magnets and magnetic elements, where the magnetic elements can be magnetically conductive pole-pieces. Each pole piece can have magnets at two of its sides. The magnets can be arranged in an alternating manner such that the field lines of the pole pieces provide a strong magnetic attachment to a magnetically conductive attraction plate of a connector insert.

These and other embodiments of the present invention can provide connectors that can form reliable connections by providing connector insert contacts that can have more than one contacting surface to connect to corresponding connector receptacle contacts. A connector insert contact can include a forked portion, where the forked portion includes an upper beam and a lower beam. Each beam can terminate in a contacting surface at a first end. The upper beam and the lower beam can connect at a second end. Contacts in the connector receptacle can have a conical cross-section such that the contacting surface of the upper beam can physically and electrically connect to a top surface of a connector receptacle contact and the contacting surface of the lower beam can physically and electrically connect to a bottom surface of the connector receptacle contact. Using more than one contacting surface can provide redundancy that can increase the reliability of a connection between the connector insert and the connector receptacle, as well as reduce the impedance of the connection between contacts.

These and other embodiments of the present invention can further improve the reliability of a connection between a connector insert and a connector receptacle by providing a shallow slope to the conical cross section of contacts in the receptacle. This slope can limit a parasitic force on the connector insert that would otherwise act to expel the connector insert from the connector receptacle. Instead, the expulsion force provided by the conical shape of the connector receptacle contacts can readily be overcome by the magnetic attraction between the connector insert and the connector receptacle.

These and other embodiments of the present invention can further improve the reliability of a connection by providing a connector insert that can rotate through a first arc relative to a connector receptacle. Various forces can act on the connector insert when it is plugged into a connector receptacle. One such force can be caused by a cable attached to the connector insert. The weight of this cable can pull down on the connector insert relative to the connector receptacle. Embodiments of the present invention can include a magnetic array to prevent a disconnection. Embodiments of the present invention can also provide an attraction plate and contacts for a connector insert that can rotate downward relative to the connector receptacle to further avoid an inadvertent disconnection.

These and other embodiments of the present invention can further improve the reliability of a connection between a connector insert and a connector receptacle by providing a contacts for a connector insert that wipe across surfaces of corresponding contacts in a connector receptacle. This wiping action can help to remove dust, corrosion buildup, and other particulate matter than could otherwise hamper a physical and electrical connection between contacts.

These and other embodiments of the present invention can provide a reliable connection despite alignment errors between a connector insert and a connector receptacle by providing contacts for the connector insert that can self-align to corresponding contacts of a connector receptacle. The contacts of the connector insert can include a joining portion that joins an anchor fixed to a board or other structure in the connector insert to a forked portion having one or more beams. The joining portion can allow the beams to move relative to the anchor, thereby allowing the contacts of the connector insert to properly mate with corresponding contacts of the connector receptacle despite misalignments of the connector insert and connector receptacle.

These and other embodiments of the present invention can provide connector inserts and connector receptacles that can avoid power sequencing problems. Specifically, power and data contacts in the connector receptacle can have a conical shape where the tip of the cone is absent and replaced by nonconductive material. Conversely, ground contacts can have a conical shape complete with the tip of the cone. As a result, ground connections can be formed before power and data connections as a connector insert is plugged into a connector receptacle, and ground connections can be broken after power and data connections when a connector insert is extracted from the connector receptacle. This make-first break-last arrangement can help to prevent power supply sequencing problems between a connector insert and a connector receptacle.

These and other embodiments of the present invention can provide connector inserts and connector receptacles that can be readily manufactured. Contacts of the connector receptacle can be formed by stamping, thereby simplifying manufacturing.

While embodiments of the present invention can provide useful connector inserts and connector receptacles for delivering power, these and other embodiments of the present invention can be used as connector receptacles in other types of connector systems, such as connector systems that can be used to convey power, data, or both.

In various embodiments of the present invention, contacts, shields, and other conductive portions of a connector receptacle or connector insert can be formed by stamping, metal-injection molding, machining, micro-machining, 3-D printing, or other manufacturing process. The conductive portions can be formed of stainless steel, steel, copper, copper titanium, phosphor bronze, or other material or combination of materials. They can be plated or coated with nickel, gold, or other material. The nonconductive portions, such as, housings, locking portions, and other structures can be formed using injection or other molding, 3-D printing, machining, or other manufacturing process. The nonconductive portions can be formed of silicon or silicone, rubber, hard rubber, plastic, nylon, liquid-crystal polymers (LCPs), ceramics, or other nonconductive material or combination of materials. The printed circuit boards or other boards used can be formed of FR-4 or other material.

Embodiments of the present invention can provide connector receptacles and connector inserts that can be located in, and can connect to, various types of devices such as portable computing devices, tablet computers, desktop computers, laptop computers, all-in-one computers, wearable computing devices, smart phones, storage devices, portable media players, navigation systems, monitors, power supplies, video delivery systems, adapters, remote control devices, chargers, and other devices. These connector receptacles and connector inserts can provide interconnect pathways for signals that are compliant with various standards such as one of the Universal Serial Bus (USB) standards including USB Type-C, High-Definition Multimedia Interface® (HDMI), Digital Visual Interface (DVI), Ethernet, DisplayPort, Thunderbolt™, Lightning™, Joint Test Action Group (JTAG), test-access-port (TAP), Peripheral Component Interconnect express, Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention can provide connector receptacles and connector inserts that can be used to provide a reduced set of functions for one or more of these standards. In various embodiments of the present invention, these interconnect paths provided by these connector receptacles and connector inserts can be used to convey power, ground, signals, test points, and other voltage, current, data, or other information.

Various embodiments of the present invention can incorporate one or more of these and the other features described herein. A better understanding of the nature and advantages of the present invention can be gained by reference to the following detailed description and the accompanying drawings.

DESCRIPTION OF ILLUSTRATIVE EMBODIMENTS

Figure 1:
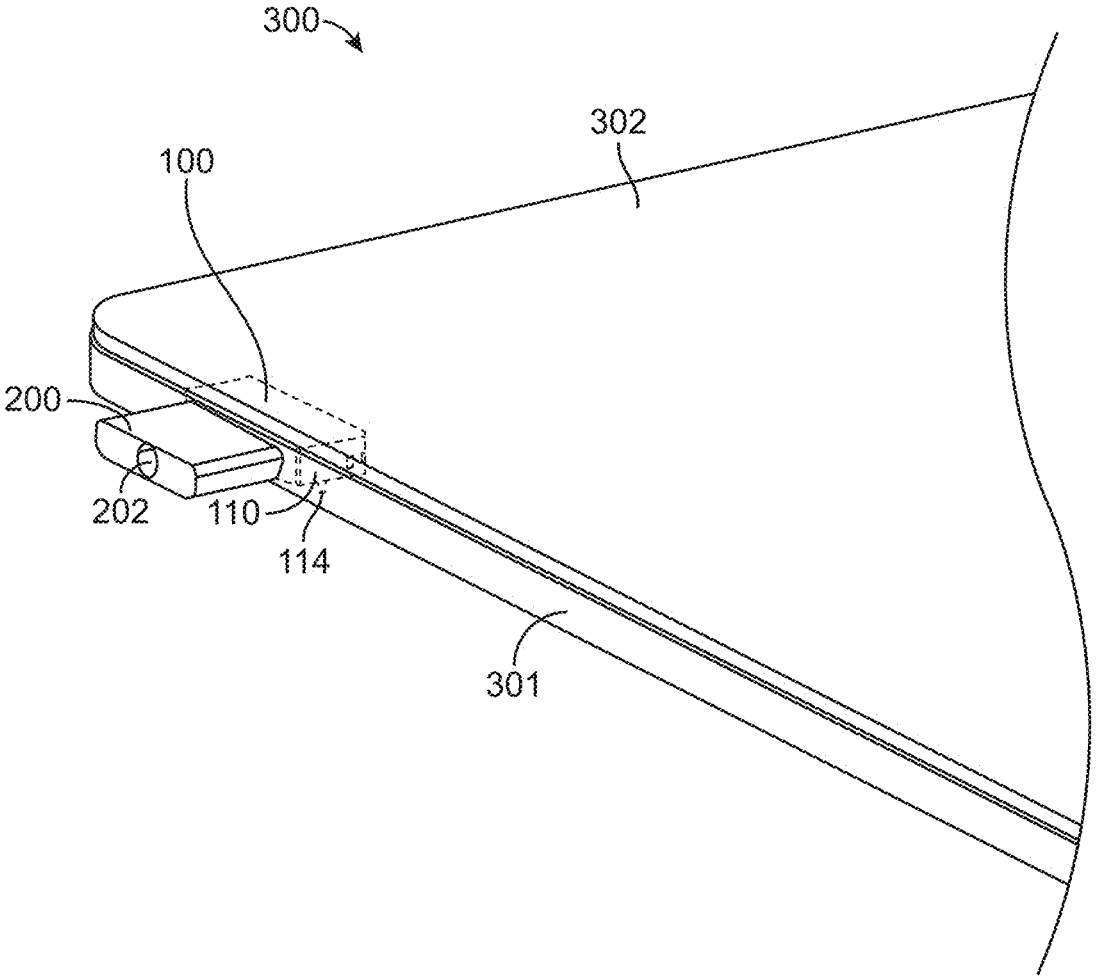
FIG. 1 illustrates an electronic system that can be improved by the incorporation of embodiments of the present invention.

FIG. 1 illustrates an electronic system that can be improved by the incorporation of an embodiment of the present invention. This figure, as with the other included figures, is shown for illustrative purposes and does not limit either the possible embodiments of the present invention or the claims.

This figure illustrates an electronic device 300 including connector receptacle 100. Electronic device 300 may include bottom housing 301 encasing connector receptacle 100. Electronic device 300 can further include top housing 302 over bottom housing 301. Top housing 302 can house a screen or monitor, or other electronic components (not shown.) Bottom housing 301 can house a keyboard, processor, battery, or other electronic components (not shown.) The electronic components in top housing 302 and bottom housing 301 can receive and provide power data or power using connector receptacle 100. In one example, the electronic components in top housing 302 and bottom housing 301 can receive power via connector receptacle 100 and can provide data regarding a charging status of a battery of electronic device 300.

Connector receptacle 100 can include top shield 110 having tabs 114. Tabs 114 can be inserted into and soldered to openings (not shown) in a printed circuit board (not shown) in bottom housing 301 of electronic device 300. Connector insert 200 can be plugged into or mated with connector receptacle 100. Connector insert 200 can include passage 202 for a cable (not shown.)

In this example, electronic device 300 can be a laptop or portable computer. In these and other embodiments of the present invention, electronic device 300 can instead be another portable computing device, tablet computer, desktop computer, all-in-one computer, wearable computing device, smart phone, storage device, portable media player, navigation system, monitor, power supply, video delivery system, adapter, remote control device, charger, or other device.

Power supplies, ground, and data signals can be conveyed by connector insert 200 and connector receptacle 100. These power supplies, ground, and signals can be compliant with and form pathways for signals that are compliant with various standards such as one of the Universal Serial Bus (USB) standards including USB Type-C, High-Definition Multimedia Interface® (HDMI), Digital Visual Interface (DVI), Ethernet, DisplayPort, Thunderbolt™, Lightning™ Joint Test Action Group (JTAG), test-access-port (TAP), Peripheral Component Interconnect express, Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention can provide connector receptacles and connector inserts that can be used to provide a reduced set of functions for one or more of these standards. In various embodiments of the present invention, these interconnect paths provided by these connector receptacles and connector inserts can be used to convey power, ground, signals, test points, and other voltage, current, data, or other information.

Examples of connector receptacles 100 and connector inserts 200 are shown in the following figures.

Figure 2:
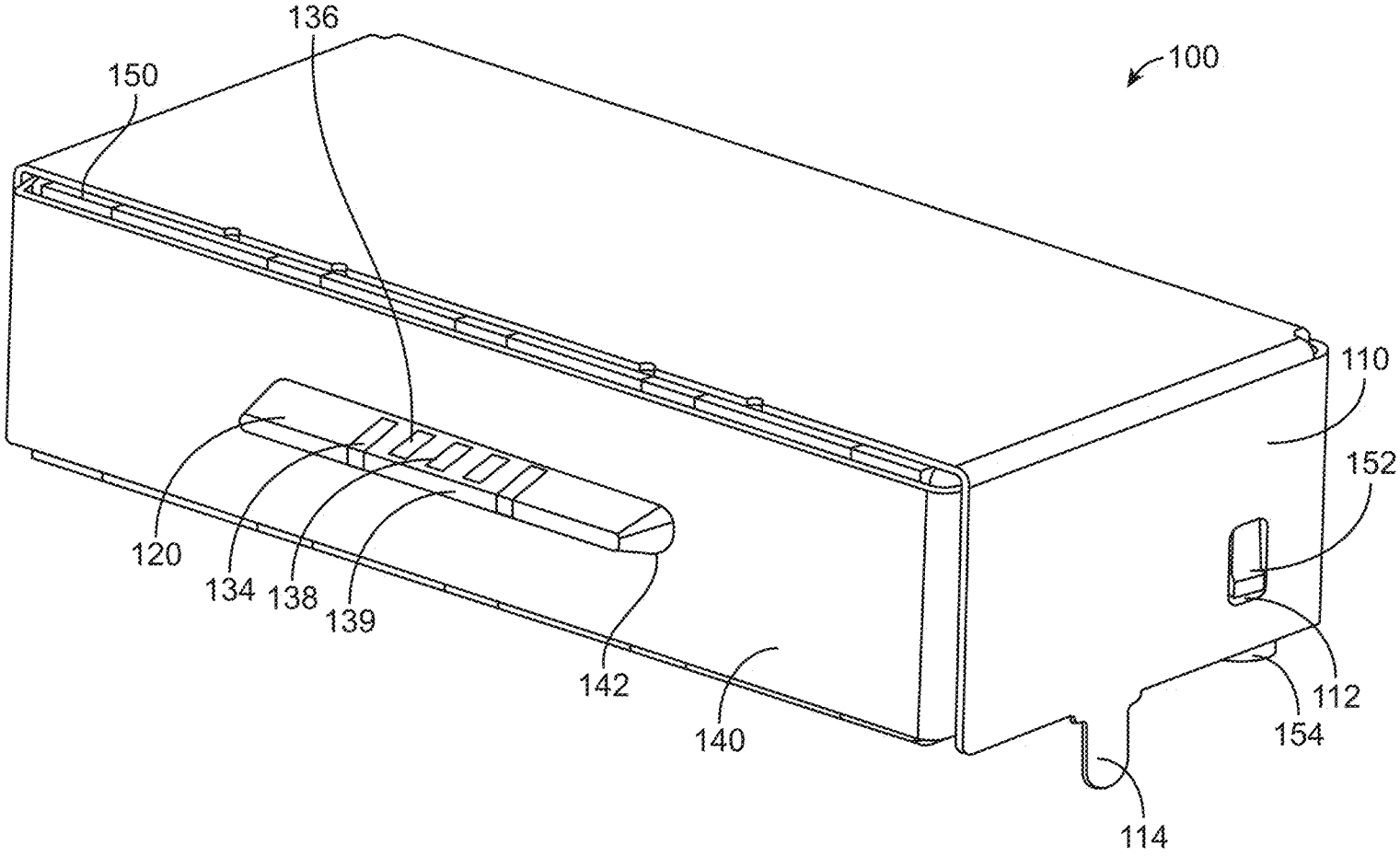
FIG. 2 illustrates a connector receptacle according to an embodiment of the present invention.

FIG. 2 illustrates a connector receptacle according to an embodiment of the present invention. Connector receptacle 100 can include mesa 120. Mesa 120 can support contacting surfaces for contacts 130 (shown in FIG. 4.) Mesa 120 can support contacting surfaces 134, contacting surfaces 136, and contacting surfaces 138. Contacting surfaces 134, contacting surfaces 136, and contacting surfaces 138 can each convey one or more of power, ground, or a signal. In one example, the two outside contacting surfaces 134 can convey ground, while the two adjacent contacting surfaces 136 can convey power. Central contacting surfaces 138 can convey a signal. The signal can be indicative of a charging status of a battery in electronic device 300 (shown in FIG. 1), though other signals can be conveyed by central contacting surface 138.

In this particular example, contacting surfaces 134 may wrap around a front edge 139 of mesa 120. Conversely, contacting surfaces 136 and contacting surfaces 138 can stop short of front edge 139 of mesa 120. This can allow corresponding contacts in connector insert 200 (shown in FIG. 5) to connect to ground contacting surfaces 134 before they connect to power contacting surfaces 136 when connector insert 200 is connected to connector receptacle 100. This can also allow corresponding contacts in connector insert 200 to disconnect from ground contacting surfaces 134 after they disconnect from power contacting surfaces 136 as connector insert 200 is disconnected from connector receptacle 100.

Mesa 120 can extend through an opening 142 in faceplate 140. Faceplate 140 and top shield 110 may shield top housing 150. Tab 152 of top housing 150 may fit in slot 112 in top shield 110 to secure top shield 110 to top housing 150. Top shield 110 can include tab 114. Tab 114 can fit in and be soldered to an opening in a printed circuit board (not shown) or other appropriate substrate. Connector receptacle 100 may be further stabilized by posts 154, which may emerge from a bottom of top housing 150.

Figure 3:
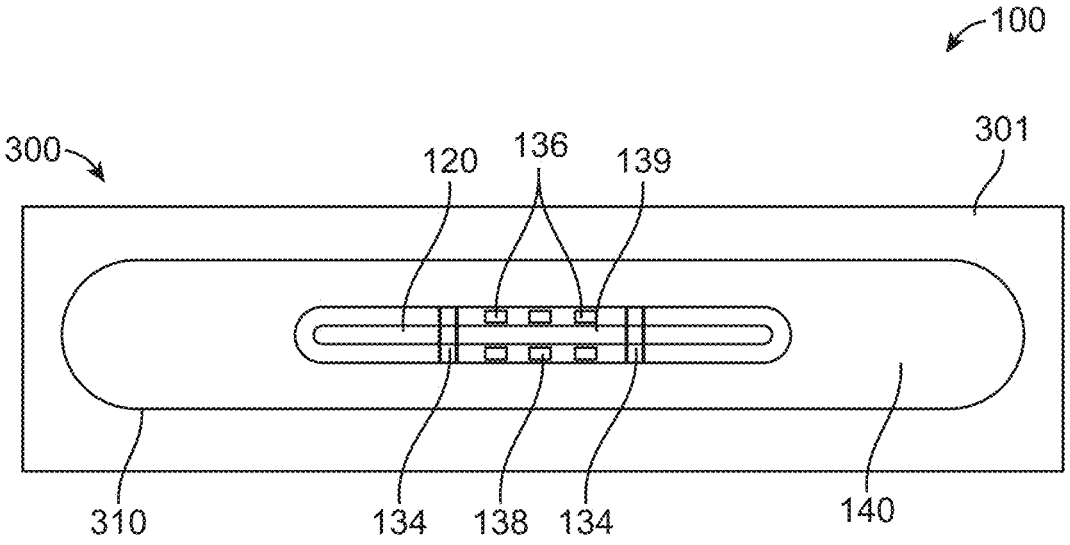
FIG. 3 is a front view of the connector receptacle of FIG. 2 positioned in the electronic device FIG. 1.

FIG. 3 is a front view of the connector receptacle of FIG. 2 positioned in the electronic device FIG. 1. In this example, connector receptacle 100 can be positioned in electronic device 300. Faceplate 140 and mesa 120 of connector receptacle 100 can be located in opening 310 of bottom housing 301 of electronic device 300. Mesa 120 can support contacting surfaces 134, contacting surfaces 136, and contacting surfaces 138. Contacting surfaces 134 can wrap around front edge 139 of mesa 120. Conversely, portions of contacting surfaces 136 and contacting surfaces 138 can stop short and be isolated each other at front edge 139.

Figure 4:
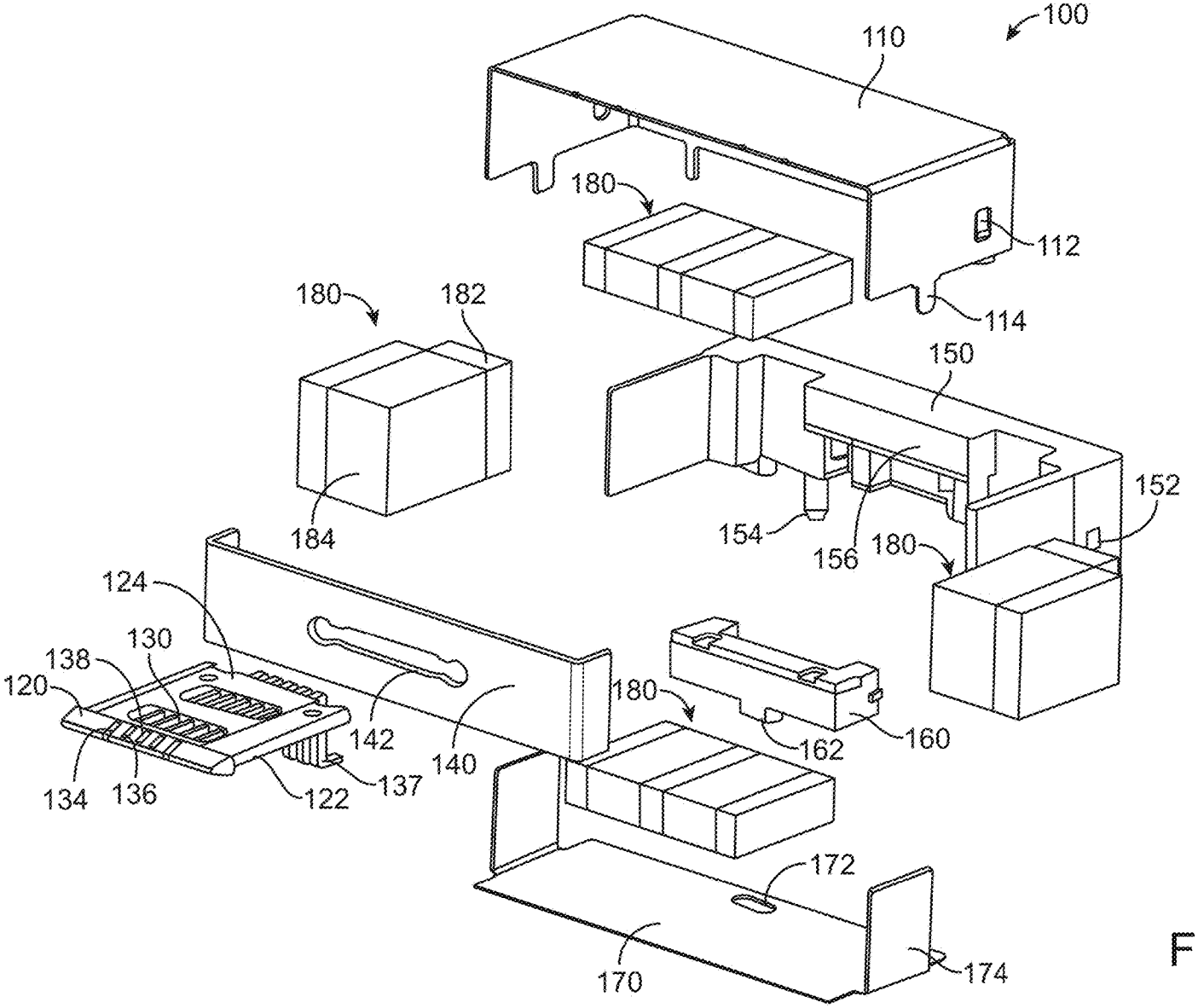
FIG. 4 is an exploded view of the connector receptacle in FIG. 2.

FIG. 4 is an exploded view of the connector receptacle in FIG. 2. Contacts 130 can be supported by contact housing 122. Contact housing 122 can terminate at a front edge in mesa 120. Mesa 120 can support contacting surfaces 134, contacting surfaces 136, and contacting surfaces 138 of contacts 130. Contacts 130 can terminate in surface-mount contacting portions 137, though in other embodiments of the present invention, contacts 130 can terminate in through-hole contacting portions (not shown.)

Mesa 120 can extend through opening 142 in faceplate 140. Contact housing 122 can include rear portion 124 that can be placed under shelf 156 of top housing 150. Locking portion 160 can fit under shelf 156 such that contact housing 122 is between shelf 156 and locking portion 160, thereby securing contact housing 122 in place. Top shield 110 can fit over top housing 150 such that tab 152 fits in slot 112, thereby securing top shield 110 to top housing 150. Top shield 110 can include tab 114. Tab 114 can be inserted into and soldered to an opening (not shown) in a printed circuit board (not shown) or other appropriate substrate. Bottom shield 170 can fit under top housing 150 and be spot or laser welded to top shield 110 along sides 174. Bottom tab 162 of locking portion 160 can fit in opening 172 in bottom shield 170, thereby providing mechanical support, along with posts 154 for connector receptacle 100.

Figure 16:
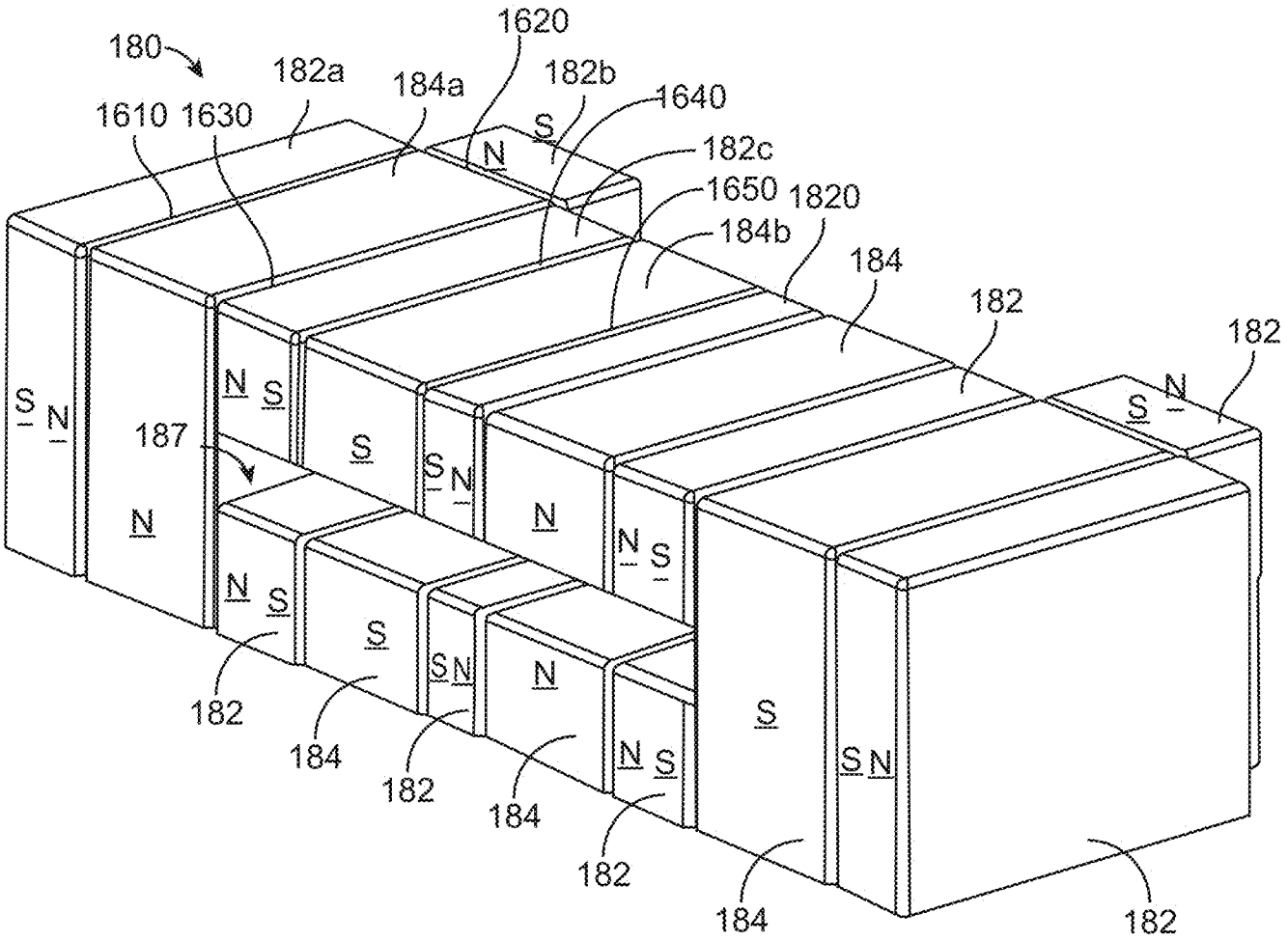
FIG. 16 illustrates a magnetic array according to an embodiment of the present invention.

Connector receptacle 100 can further include a magnetic array 180. Magnetic array 180 can be formed of magnets 182 and magnetic elements or pole pieces 184. Magnets 182 and pole pieces 184 can be positioned around contact housing 122. Further details of magnetic array 180 are shown in FIG. 16 below. Magnetic array 180 can provide a strong attachment between connector receptacle 100 and connector insert 200 (shown in FIG. 5.) Each pole piece 184 can have magnets at more one or more than one of its sides. The magnets can be arranged an alternating manner such that field lines between the pole pieces provide a strong magnetic attraction to a magnetically conductive attraction plate 210 (shown in FIG. 5) of connector insert 200. Strong magnetic attraction can allow the use of a low profile connector receptacle 100 and connector insert 200, thereby allowing connector receptacle 100 to be used in a thin or low-profile electronic device 300 (shown in FIG. 1.)

Figure 5:
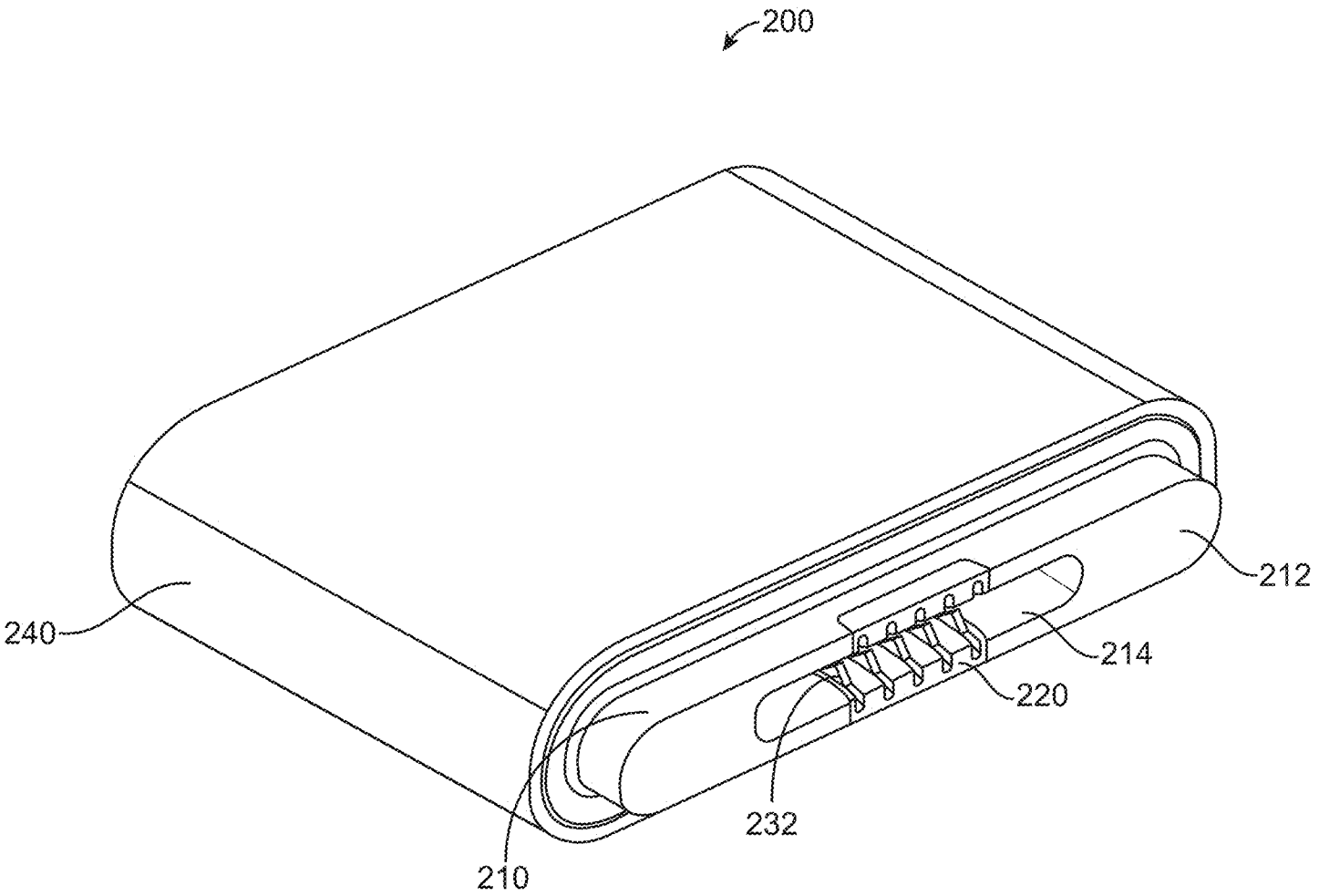
FIG. 5 illustrates a connector insert according to an embodiment of the present invention.

FIG. 5 illustrates a connector insert according to an embodiment of the present invention. Connector insert 200 can be housed by shell 240. Front extension 212 of attraction plate 210 can be arranged to fit in opening 310 of bottom housing 301 of electronic device 300 as shown in FIG. 3. Front extension 212 can support contact housing 220. Contact housing 220 can support contacts 230 (shown in FIG. 8) having contacting portions 232. Contacting portions 232 can be exposed in recess 214 in front extension 212 of attraction plate 210.

Figure 6:
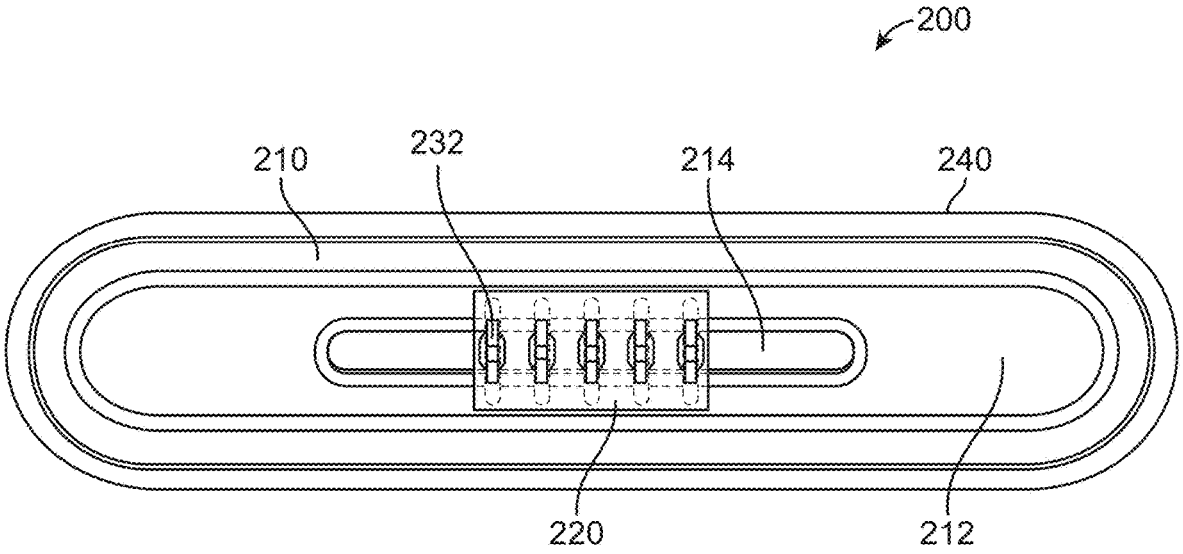
FIG. 6 illustrates a front view of the connector insert of FIG. 5.

FIG. 6 illustrates a front view of the connector insert of FIG. 5. In this example, connector insert 200 can be housed in shell 240. Front extension 212 of attraction plate 210 can support housing 220. Housing 220 can support contacts 230 (shown in FIG. 8) having contacting portions 232. Contacting portions 232 can be exposed in recess 214 of front extension 212.

Figure 7:
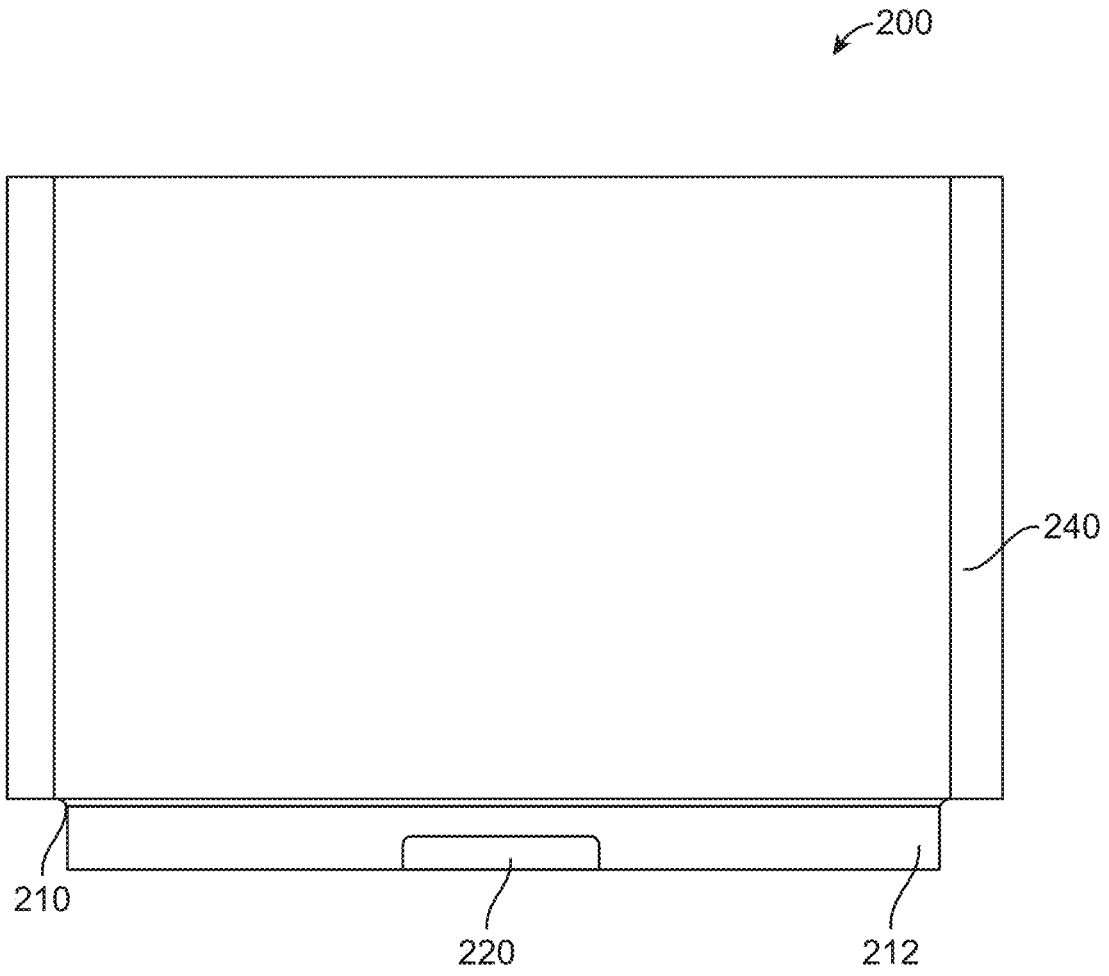
FIG. 7 illustrates a top view of the connector insert of FIG. 5.

FIG. 7 illustrates a top view of the connector insert of FIG. 5. Connector insert 200 can be housed by shell 240. Front extension 212 can extend from attraction plate 210 and can support housing 220.

Figure 8:
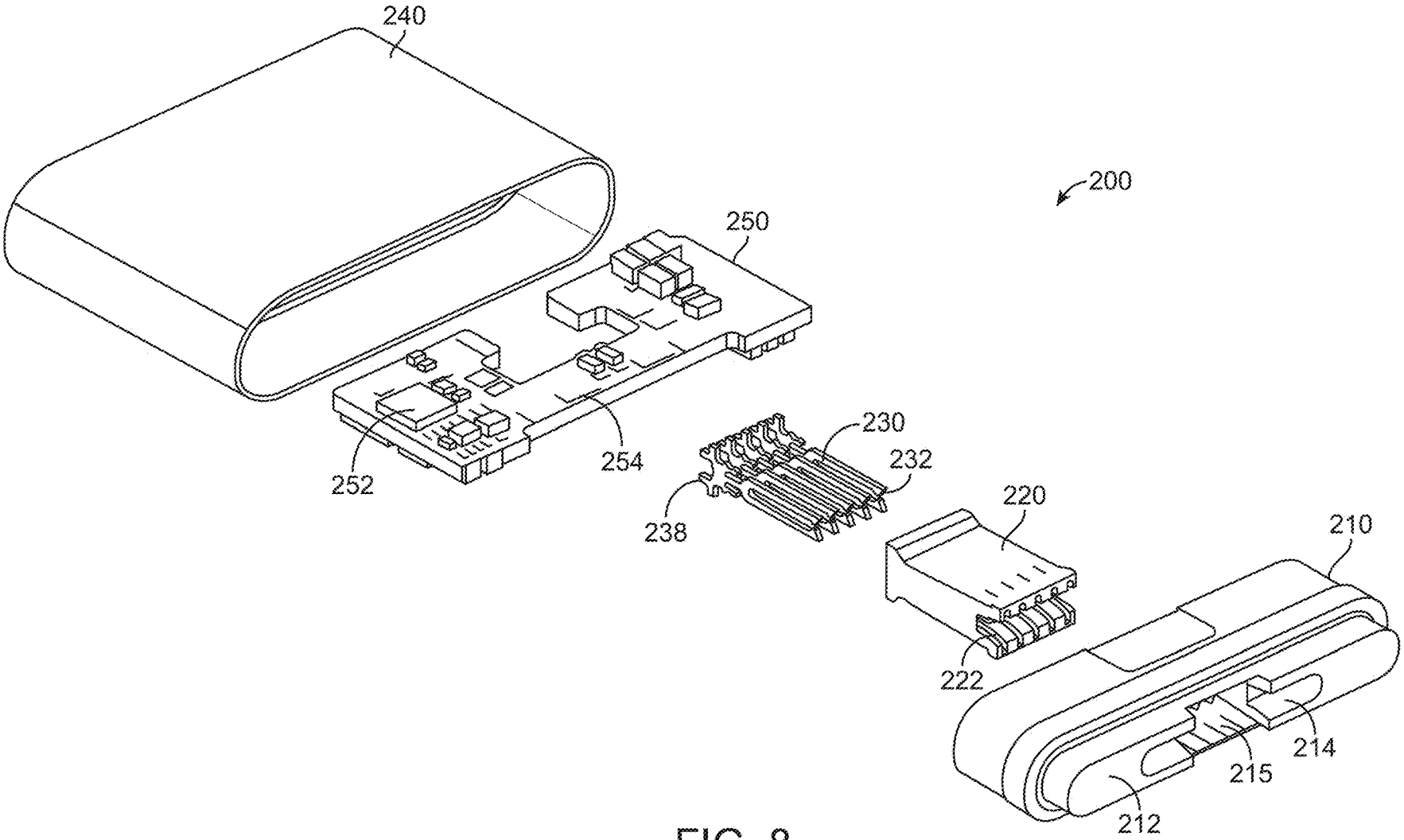
FIG. 8 is an exploded view of the connector insert of FIG. 5.

FIG. 8 is an exploded view of the connector insert of FIG. 5. Connector insert 200 can include shell 240 and attraction plate 210. Shell 240 and attraction plate 210 can enclose housing 220, contacts 230, and board 250. Housing 220 can fit in passage 215 of attraction plate 210. Recess 214 can be formed in front extension 212 of attraction plate 210. Slots 222 can be formed in housing 220. Contacts 230 can be located in slots 222 in housing 220. Housing 220 can be formed around contacts 230, or contacts 230 can be inserted into housing 220.

Contacting portions 232 of contacts 230 can be available at a front of housing 220 in recess 214 of attraction plate 210. Contacts 230 can further include anchors 238. Anchors 238 can be soldered to pads (not shown) along front edge 254 of board 250. Board 250 can support electronics 252. Electronics 252 can include one or more light emitting diodes to indicate that a connection has been made between connector insert 200 and connector receptacle 100, as shown in FIG. 1. These light emitting diodes can be color coded to indicate a charging status of a battery in electronic device 300 (shown in FIG. 1.) For example, the light emitting diodes can indicate that a battery is being charged, is fully charged, or other status information. This status information can be conveyed from connector receptacle 100 to connector insert 200 over center contacting portion 318 and a corresponding contact 230.

Figure 9:
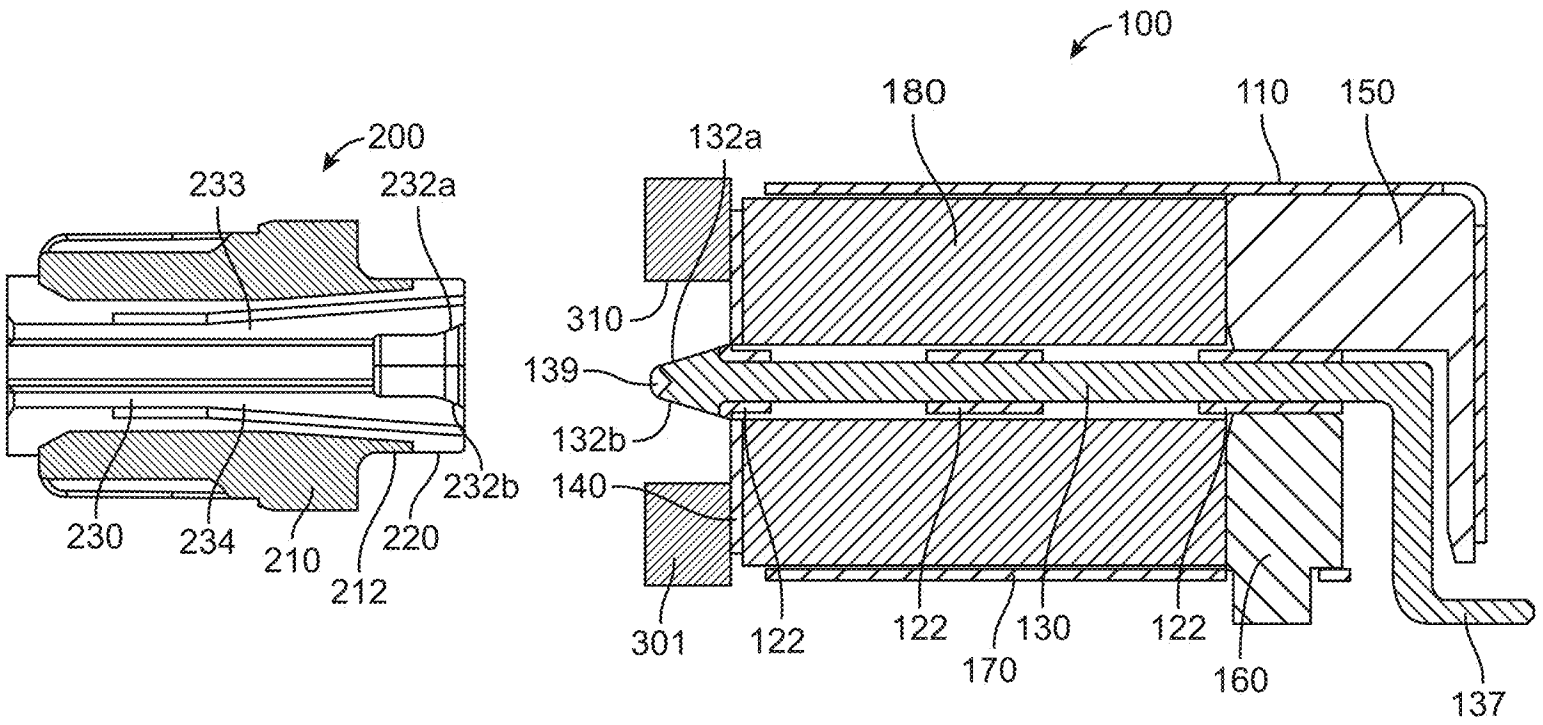
FIG. 9 illustrates a cutaway side view of a connector insert and a connector receptacle according to an embodiment of the present invention.

FIG. 9 illustrates a cutaway side view of a connector insert and a connector receptacle according to an embodiment of the present invention. Connector receptacle 100 can include contacts 130 supported by contact housing 122. Contacts 130 can terminate in contacting surface 132A and contacting surface 132B on mesa 120 (shown in FIG. 4.) Contacting surface 132A and contacting surface 132B can be separated from each other at front edge 139 of mesa 120. Contacting surface 132A and contacting surface 132B of contact 130 can be located in opening 310 in bottom housing 301 of electronic device 300 (shown in FIG. 1.) Contacts 130 can terminate in surface-mount contacting portions 137, though in these and other embodiments of the present invention, contacts 130 can terminate in through-hole contacting portions (not shown.) Surface-mount contacting portions 137 can be soldered to pads (not shown) on a printed circuit board (not shown) or other appropriate substrate, while through-hole contacting portions can be inserted into and soldered to holes in a printed circuit board or other appropriate substrate.

Connector receptacle 100 can further include magnet array 180, top housing 150, and locking portion 160. Contact housing 122 can be held in place between top housing 150 and locking portion 160 and can pass through opening 187 (shown in FIG. 16) in magnetic array 180. Top shield 110, along with faceplate 140 and bottom shield 170, can electrically shield connector receptacle 100.

Connector insert 200 can include contacts 230 supported by housing 220. Housing 220 can be supported by front extension 212 of attraction plate 210. Contact 230 can include upper beam 233 terminating in contacting surface 232A, and lower beam 234 terminating in contacting surface 232B. Contacting surface 232B can physically and electrically connect to contacting surface 132B of contacts 130, and contacting surface 232B can physically and electrically connect to contacting surface 132B of contact 130 when connector insert 200 is inserted into connector receptacle 100.

In this particular example, contact 130 can terminate in a conical contacting portion were a tip has been removed and replaced by nonconductive front edge 139, thereby leaving contacting surfaces 132A and contacting surface 132B exposed. Contacting surface 132A and contacting surface 132B can be used as contacting surfaces 136 or contacting surfaces 138, or other contacting surfaces. Other contacts 130 can terminate in a conical contacting portion were a tip is not been removed. For example, contacting surface 134 (shown in FIG. 4) can be formed as a conical contacting portion were a tip is not been removed.

Figure 10:
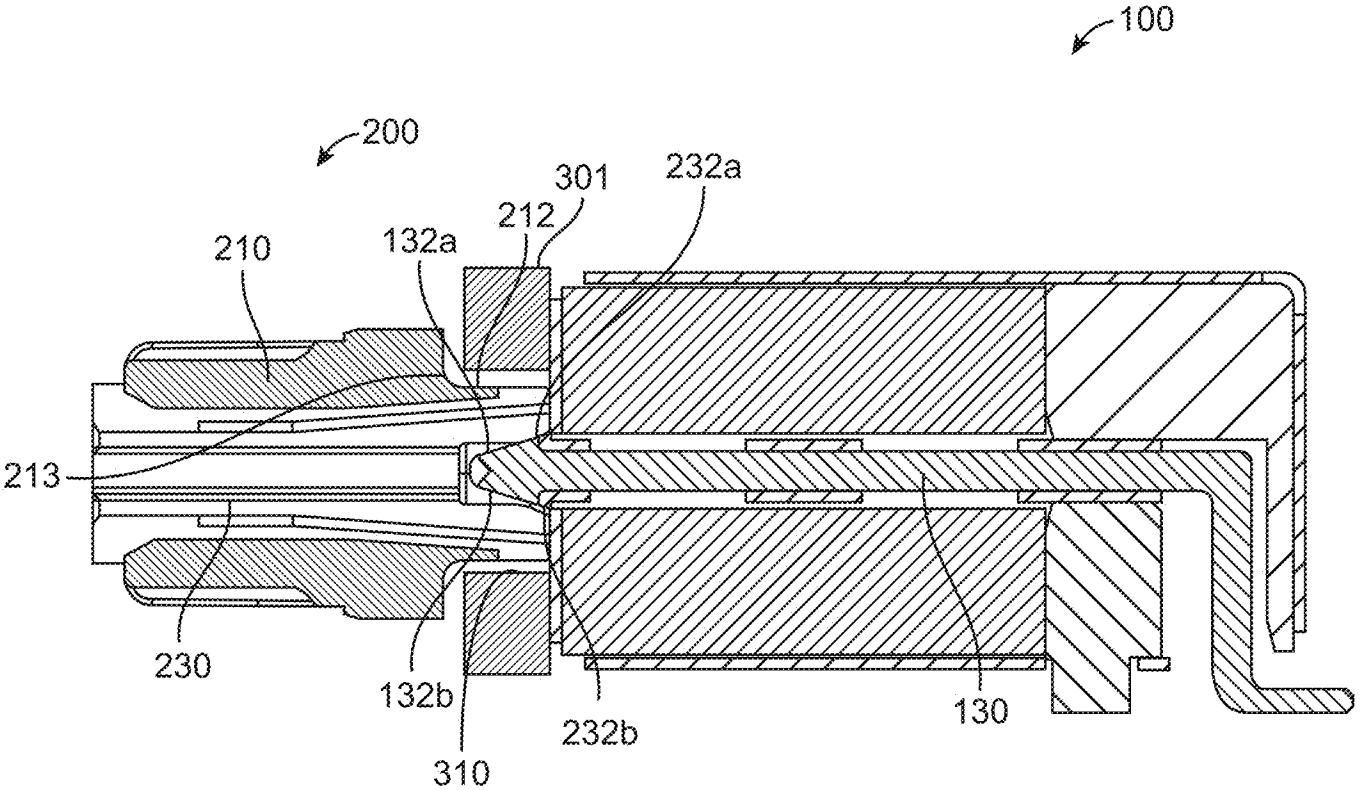
FIG. 10 illustrates a cutaway side view of a connector insert mated with a connector receptacle according to embodiments of the present invention.

FIG. 10 illustrates a cutaway side view of a connector insert mated with a connector receptacle according to embodiments of the present invention. In this example, connector insert 200 has been mated with connector receptacle 100. Specifically, front extension 212 of attraction plate 210 has been inserted into opening 310 in bottom housing 301 of electronic device 300 (shown in FIG. 1.) Contact 130 in connector receptacle 100 can include contacting surface 132A and contacting surface 132B which can physically and electrically connect to contacting surface 232A and contacting surface 232B of contact 230 in connector insert 200.

In this example, contact 230 in connector insert 200 can include two contacting surfaces, specifically, contacting surface 232A and contacting surface 232B. Each of these contacting surfaces can physically and electrically connect to corresponding contacting surfaces of contact 130 in connector receptacle 100, specifically contacting surface 132A and contacting surface 132B. Providing two contacting surfaces in this way can provide redundancy, thereby improving the reliability of a connection between connector insert 200 and connector receptacle 100. The use of two such contacting surfaces can also reduce the impedance of the connection between contact 230 in connector insert 200 and contact 130 in connector receptacle 100.

Contact 130 in connector receptacle 100 can terminate in in a conical contact portion that forms contacting surface 132A and contacting surface 132B. The slope on this conical contact portion can be relatively shallow. This can in turn provide a self-wiping feature as connector insert 200 is inserted into and extracted from connector receptacle 100. Specifically, contacting surface 232A and contacting surface 232B can wipe across contacting surface 132A and contacting surface 132B during the insertion and extraction of connector insert 200 from connector receptacle 100. This can act to remove corrosion, debris, or other particulate matter from these surfaces, thereby improving reliability and reducing the impedance of a connection between contact 230 in connector insert 200 and connector receptacle 100.

When connector insert 200 is inserted in connector receptacle 100, various forces may act on connector insert 200.

One such force may be that of a cable (not shown) pulling down on a back end of connector insert 200. This can tend to rotate connector insert 200 out of connector receptacle 100, thereby causing an inadvertent disconnection. Accordingly, connector insert 200 may be arranged such that connector insert 200 may rotate through an angle without disconnecting from connector receptacle 100. For example, front extension 212 may have a curved surface 213 leading into the remainder of attraction plate 210. This curvature, along with shape of contacting surface 232A and contacting surface 232B, can allow connector insert 200 to rotate through an angle without disconnecting from connector receptacle 100.

Another force that can act to create an inadvertent disconnection is the force generated by contacting surface 232A and contacting surface 232B on contacting surface 132A and contacting surface 132B. These forces can act to expel connector insert 200 from connector receptacle. Accordingly, in these and other embodiments of the present invention, a slope of contacting surface 132A and contacting surface 132B can be made shallow to reduce the expulsion force. Also, a magnetic attraction between magnetic array 180 and attraction plate 210 can be high such that the expulsion force is readily overcome.

Figure 11:
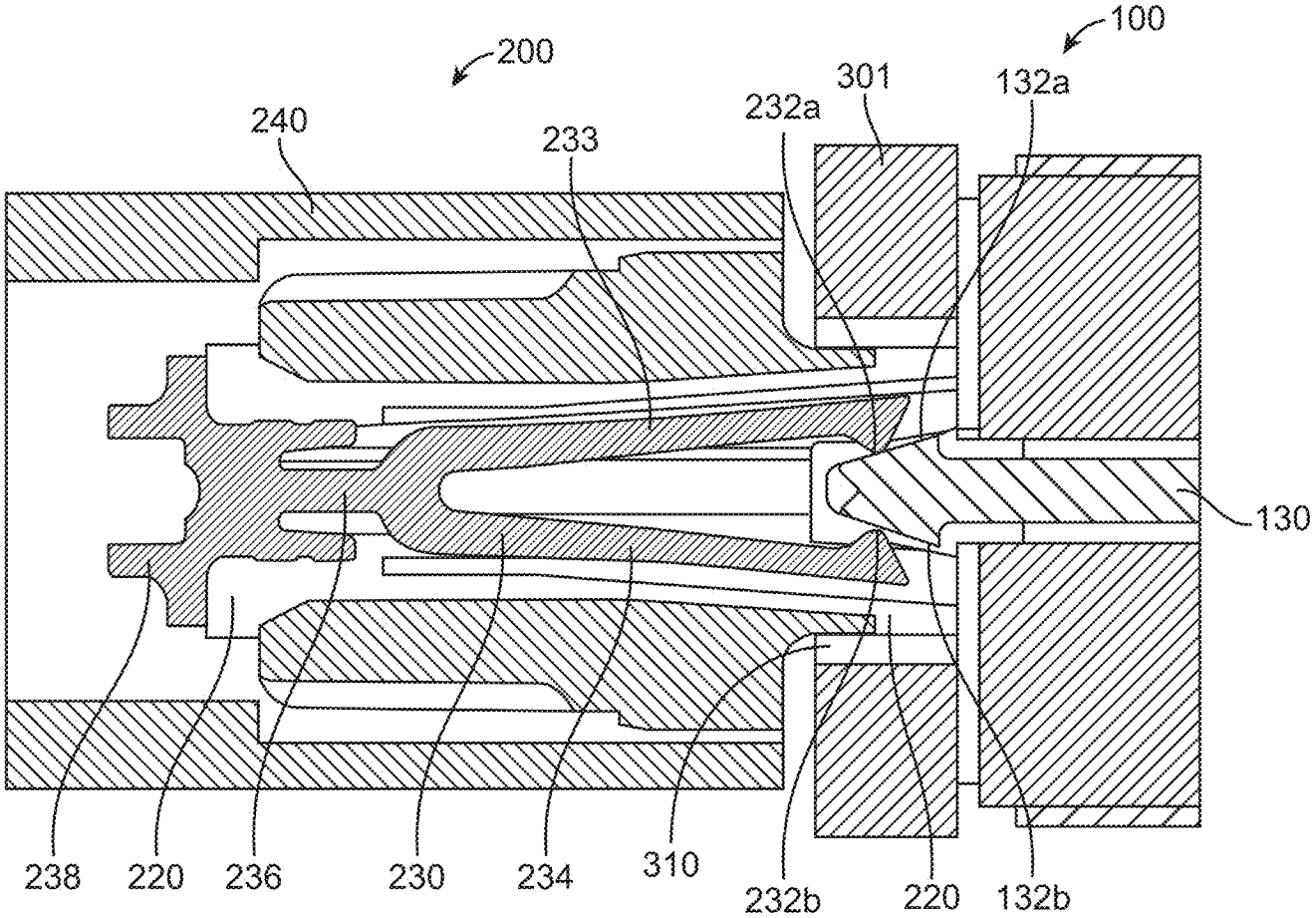
FIG. 11 is a close-up cross-section view of a connector insert mated with a connector receptacle according to an embodiment of the present invention.

FIG. 11 is a close-up cross-section view of a connector insert mated with a connector receptacle according to an embodiment of the present invention. In this example, connector receptacle 100 can be located in opening 310 in bottom housing 301 of electronic device 300 (shown in FIG. 1.) Connector receptacle 100 can include contact 130. Contact 130 can terminate in contacting surface 132A and contacting surface 132B. Contacting surface 132A can physically and electrically connect to contacting surface 232A of contact 230 in connector insert 200. Contacting surface 132B can physically and electrically connect to contacting surface 232B of contact 230. Again, contacting surface 132A and contacting surface 132B can be used as contacting surfaces 136 or contacting surfaces 138.

Contact 230 can include upper beam 233 that can terminate in contacting surface 232A, and lower beam 234 that can terminate in contacting surface 232B. Contact 230 can further include anchor 238, which may be soldered or otherwise fixed to a board or other stable structure. Anchor 238 can be connected to a forked portion comprising upper beam 233 and lower beam 234 through joining portion 236. Contact 230 can be supported by housing 220 in attraction plate 210. Shell 240 can house contact 230 and housing 220.

In these and other embodiments of the present invention, it can be desirable for a connector insert and a connector receptacle to mate properly despite the presence of a lateral or rotational misalignment. Accordingly, embodiments of the present invention can provide contacts that can accommodate such a misalignment. Examples are shown in the following figures.

Figure 12:
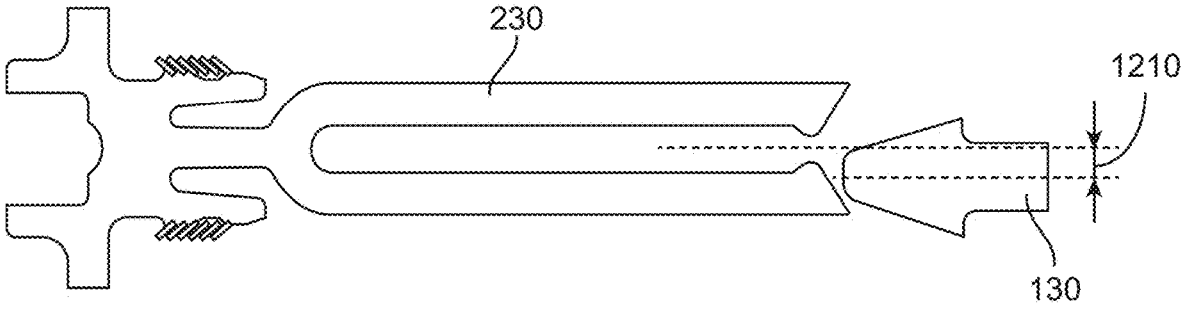
FIGS. 12-15 illustrates a contact of a connector insert mating with and then disconnecting from a contact of a connector receptacle according to an embodiment of the present invention.

FIGS. 12-15 illustrates a contact of a connector insert mating with and then disconnecting from a contact of a connector receptacle according to an embodiment of the present invention. In FIG. 12, contact 230 is about to be mated with contacts 130. Contact 230 is shown as being misaligned with contact 130 by an amount 1210.

Figure 13:
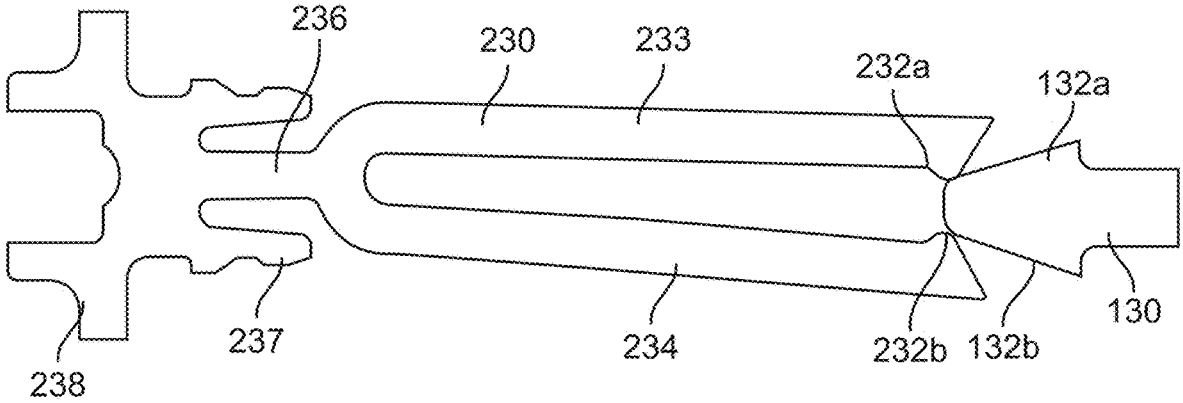

In FIG. 13, contacting surface 132A of contact 130A has begun to engage contacting surface 232A of contact 230. Similarly, contacting surface 132B of contact 130 has begun to engage contacting surface 232B of contact 230. Anchor 238 can be fixed in place by being soldered to board 250 (shown in FIG. 9) or other structure. Barbs 237 can be inserted into housing 220 (shown in FIG. 9) in order to secure contacts 230 to housing 220. Anchor 238 can be attached to upper beam 233 and lower beam 234 by joining portion 236. Joining portion 236 can flex downward, thereby allowing contacting surface 232A and contacting surface 232B to engage contacting surface 132A and contacting surface 132B of contact 130. The downward deflection provided by joining portion 236 can allow contacting surface 232A to engage contacting surface 132A earlier than might otherwise be possible. This can reduce the stress on contacting surface 232B and lower beam 234. This reduction in stress can reduce the permanent deformation of contact 230 thereby resulting in as more fatigue resistant design.

Figure 14:
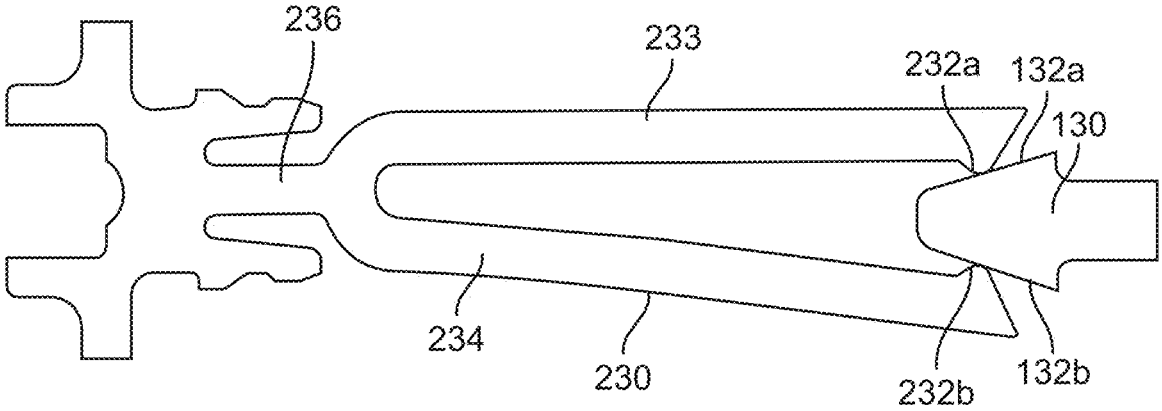

In FIG. 14, joining portion 236 of contact 230 can flex downward while upper beam 233 and lower beam 234 can separate as contacting surface 232A rides up the sloped surface of contacting surface 132A and contacting surface 232B rides down the slope surface of contacting surface 132B. Again, the movement between the contact positions shown in FIG. 13 and FIG. 14 can provide a wiping action across the various contacting surfaces, thereby helping to keep them clear of debris, corrosion, and other particulate matter or contaminates in order to improve reliability of connection and reduce impedance.

Figure 15:
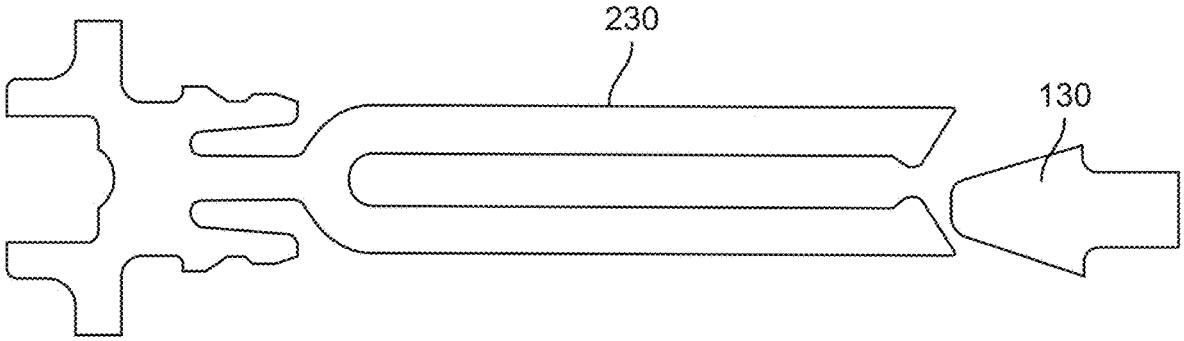

In FIG. 15, contact 130 has been extracted from contact 230, contact 230 can return to its normal position.

FIG. 16 illustrates a magnetic array according to an embodiment of the present invention. Magnetic array 180 can include magnets 182 and pole pieces 184. Each pole piece 184 can convey field lines with either a North or a South polarity as shown. Each pole piece 184 can have magnets at two or more surfaces. Each North pole piece 184 can have magnets 182 oriented with their North pole at a surface of the pole piece 184 and a South pole away from the surface of the pole piece 184. Each South pole piece 184 can have magnets 182 oriented with their South pole at a surface of the pole piece 184 and a North pole away from the surface of the pole piece 184. These surfaces can be adjacent surfaces or opposite surfaces. For example, pole piece 184A can have magnet 182A a magnet at first surface 1610 and magnet 182B at second surface 1620, where first surface 1610 and second surface 1620 are adjacent surfaces. Pole piece 184A can further have magnet 182C at third surface 1630, where third surface 1630 is opposite first surface 1610 and adjacent to second surface 1620. Pole piece 184B can have magnet 182C at fourth surface 1640 and magnet 182D at fifth surface 1650, where fourth surface 1640 and fifth surface 1650 are opposite surfaces. The remaining pole pieces may be configured in a similar manner.

While embodiments of the present invention can provide useful connector inserts and connector receptacles for delivering power, these and other embodiments of the present invention can be used as connector receptacles in other types of connector systems, such as connector systems that can be used to convey power, data, or both.

In various embodiments of the present invention, contacts, shields, and other conductive portions of a connector receptacle or connector insert can be formed by stamping, metal-injection molding, machining, micro-machining, 3-D printing, or other manufacturing process. The conductive portions can be formed of stainless steel, steel, copper, copper titanium, phosphor bronze, or other material or combination of materials. They can be plated or coated with nickel, gold, or other material. The nonconductive portions, such as, housings, locking portions, and other structures can be formed using injection or other molding, 3-D printing, machining, or other manufacturing process. The nonconductive portions can be formed of silicon or silicone, rubber, hard rubber, plastic, nylon, liquid-crystal polymers (LCPs), ceramics, or other nonconductive material or combination of materials. The printed circuit boards or other boards used can be formed of FR-4 or other material.

Embodiments of the present invention can provide connector receptacles and connector inserts that can be located in, and can connect to, various types of devices such as portable computing devices, tablet computers, desktop computers, laptop computers, all-in-one computers, wearable computing devices, smart phones, storage devices, portable media players, navigation systems, monitors, power supplies, video delivery systems, adapters, remote control devices, chargers, and other devices. These connector receptacles and connector inserts can provide interconnect pathways for signals that are compliant with various standards such as one of the Universal Serial Bus (USB) standards including USB Type-C, High-Definition Multimedia Interface® (HDMI), Digital Visual Interface (DVI), Ethernet, DisplayPort, Thunderbolt™, Lightning™, Joint Test Action Group (JTAG), test-access-port (TAP), Peripheral Component Interconnect express, Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention can provide connector receptacles and connector inserts that can be used to provide a reduced set of functions for one or more of these standards. In various embodiments of the present invention, these interconnect paths provided by these connector receptacles and connector inserts can be used to convey power, ground, signals, test points, and other voltage, current, data, or other information.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector insert comprising:

an attraction plate having a passage forming a front opening;

a housing located in the passage;

a board comprising a plurality of pads;

a plurality of contacts located in the housing, each contact in the plurality of contacts comprising:

an anchor at a first end, the anchor soldered to a corresponding pad on the board;

a forked portion, the forked portion including an upper beam and a lower beam, the upper beam positioned away from the lower beam in a first direction, each beam terminating in a contacting surface at a first end, the upper beam and the lower beam joined together at a second end of the upper beam and a second end of the lower beam; and a joining portion extending from the anchor to the second end of the upper beam and the second end of the lower beam, wherein the joining portion is narrower than the forked portion in the first direction; and a shell around the board.

2. The connector insert of claim 1 wherein the joining portion allows the forked portion to move relative to the anchor.

3. The connector insert of claim 1 wherein the joining portion allows the forked portion to move in the first direction relative to the anchor.

4. The connector insert of claim 3 wherein each contact in the plurality of contacts further comprises a barb, the barb inserted into the housing to secure the contact to the housing.

5. The connector insert of claim 3 wherein each contact in the plurality of contacts further comprises a first barb and a second barb, the first barb extending from the anchor towards the first end and above the joining portion, the second barb extending from the anchor towards the first end and below the joining portion, wherein the first barb and the second barb are inserted into the housing to secure the contact to the housing.

6. The connector insert of claim 3 wherein the shell and the attraction plate enclose the housing, the plurality of contacts, and the board.

7. The connector insert of claim 3 wherein the housing is nonconductive.

8. The connector insert of claim 3 further comprising a plurality of circuits on the board.

9. The connector insert of claim 1 wherein the joining portion is narrower than the anchor in the first direction.

10. The connector insert of claim 1 wherein each contacting surface is formed as a protrusion extending towards the opposing beam.

11. A connector receptacle comprising:

a contact housing having a mesa, the mesa formed as a tapered front end of the contact housing;

a first plurality of contacts supported by the contact housing, each of the first plurality of contacts having a contacting surface on the mesa;

a second plurality of contacts supported by the contact housing, each of the second plurality of contacts having a plurality of contacting surfaces on the mesa; and a plurality of magnets and a plurality of magnetic elements positioned around the contact housing, wherein each of the plurality of magnetic elements has a first magnet adjacent to a first side of the magnetic element and a second magnet adjacent to a second side of the magnetic element.

12. The connector receptacle of claim 11 further comprising a top housing around the top, back, and side of the plurality of magnets and the plurality of magnetic elements.

13. The connector receptacle of claim 12 further comprising shielding around the top housing, the plurality of magnets, and the plurality of magnetic elements.

14. The connector receptacle of claim 13 wherein the shielding comprises a face plate, the face plate having an opening such that the mesa extends through the opening.

15. The connector receptacle of claim 14 wherein the shielding further comprises:

a top shell over the top, sides, and back of the top housing, the top shell attached to the face plate; and a bottom shell under the bottom and over the sides of the top housing, the bottom shell attached to the top shell.

16. The connector receptacle of claim 15 further comprising a lock portion, wherein the contact housing is located between the top housing and the lock portion.

17. The connector receptacle of claim 16 wherein the lock portion fits with the top housing to secure the contact housing in place.

18. A connector receptacle comprising:

a plurality of contacts;

a first magnetic element having a first magnet at a first surface and a second magnet at a second surface, the first surface adjacent to the second surface; and a second magnetic element having a third magnet at a first surface and a fourth magnet at a second surface, the first surface opposite the second surface.

19. The connector receptacle of claim 18 wherein the plurality of contacts are arranged as a line of contacts, the first magnet element is at a first end of the line of contacts, and the second magnetic element is below the line of contacts.

20. The connector receptacle of claim 19 further comprising:

a third magnetic element having a fifth magnet at a first surface and a sixth magnet at a second surface, the first surface adjacent to the second surface, wherein the third magnetic element is at a second end of the line of contacts.

21. The connector receptacle of claim 20 further comprising:

a fourth magnetic element having a seventh magnet at a first surface and the fourth magnet at a second surface, the first surface opposite to the second surface, wherein the fourth magnetic element is below the line of contacts.

22. The connector receptacle of claim 21 further comprising:

a fifth magnetic element having an eighth magnet at a first surface and a ninth magnet at a second surface, the first surface opposite to the second surface; and a sixth magnetic element having the ninth magnet at a first surface and a tenth magnet at a second surface, the first surface opposite to the second surface, wherein the fifth magnetic element and the sixth magnetic element are above the line of contacts.

23. A connector insert comprising:

an attraction plate having a passage forming a front opening;

a housing located in the passage;

a board comprising a plurality of pads;

a plurality of contacts located in the housing, each contact in the plurality of contacts comprising:

an anchor at a first end, the anchor soldered to a corresponding pad on the board;

a forked portion, the forked portion including an upper beam and a lower beam, each beam terminating in a contacting surface at a first end, wherein each contacting surface is formed as a protrusion extending towards the opposing beam, the upper beam and the lower beam joined together at a second end of the upper beam and a second end of the lower beam; and a joining portion between the anchor, the second end of the upper beam, and the second end of the lower beam; and a shell around the board.

24. The connector insert of claim 23 wherein each contact in the plurality of contacts further comprises a barb, wherein the barb is inserted into the housing to secure the contact to the housing.

25. The connector insert of claim 23 wherein each contact in the plurality of contacts further comprises a first barb and a second barb, the first barb extending from the anchor towards the first end and above the joining portion, the second barb extending from the anchor towards the first end and below the joining portion, wherein the first barb and the second barb are inserted into the housing to secure the contact to the housing.

26. The connector insert of claim 23 wherein the upper beam is positioned away from the lower beam in a first direction, and the joining portion extends from the anchor to the second end of the upper beam and the second end of the lower beam.

27. The connector insert of claim 23 wherein the upper beam is positioned away from the lower beam in a first direction and the joining portion is narrower than the forked portion in the first direction.

28. The connector insert of claim 27 wherein the joining portion is narrower than the anchor in the first direction.

* * * * *